United States Patent [19]

Ward et al.

[11] 4,012,710

[45] Mar. 15, 1977

[54] MULTIPLE OUTPUT POTENTIOMETER NETWORK

[75] Inventors: Frank L. Ward, Kensington; Victor J. Carbonneau, Exeter, both of N.H.

[73] Assignee: Clarostat Mfg. Co., Inc., Dover, N.H.

[22] Filed: May 6, 1976

[21] Appl. No.: 683,729

[52] U.S. Cl. ..... 338/128; 338/123; 338/137; 338/160

[51] Int. Cl.[2] ..... H01C 10/16

[58] Field of Search ..... 338/122, 123, 128, 137, 338/160

[56] References Cited

UNITED STATES PATENTS 2,883,499 4/1959 Kilby et al. ..... 338/128 X

*Primary Examiner*—C. L. Albritton

[57] ABSTRACT

A multiple output potentiometer network having a low resistance zone to provide the output function characteristic and a high resistance zone with which each of a plurality of output contacts is in contact providing a high degree of electrical isolation between the output contacts of said plurality.

2 Claims, 5 Drawing Figures

MULTIPLE OUTPUT POTENTIOMETER NETWORK

BACKGROUND OF THE INVENTION

Potentiometers having resistance elements along which a wiper is moved to provide a single voltage output are well known. There are however a number of applications where a number of related voltages are desired. Attempting to achieve multiple outputs from a single potentiometer has been unsuccessful because the multiple outputs become dependent and affected by the connections made thereto which affect and frequently destroy the ability of the user to achieve the desired function characteristic from each output.

SUMMARY OF THE INVENTION

A multiple output potentiometer network including in combination a non-electrical conducting substrate, a thin layer of high resistance material disposed upon the substrate, first and second zones of said high resistance material, a thin layer of low resistance material disposed on said first zone, a plurality of output members mounted on the substrate in spaced relation, a wiper member of each output member in contact with the high resistance zone and movable thereon through a limited path, first and second termination means, first and second trimmer resistance means between the first termination means and the second termination means respectively, means for applying a voltage potential between the first and second termination means, and means for taking an output voltage between one of the termination means and each of said output members.

DESCRIPTION OF THE PREFERRED EMBODIMENT

Figure 1:
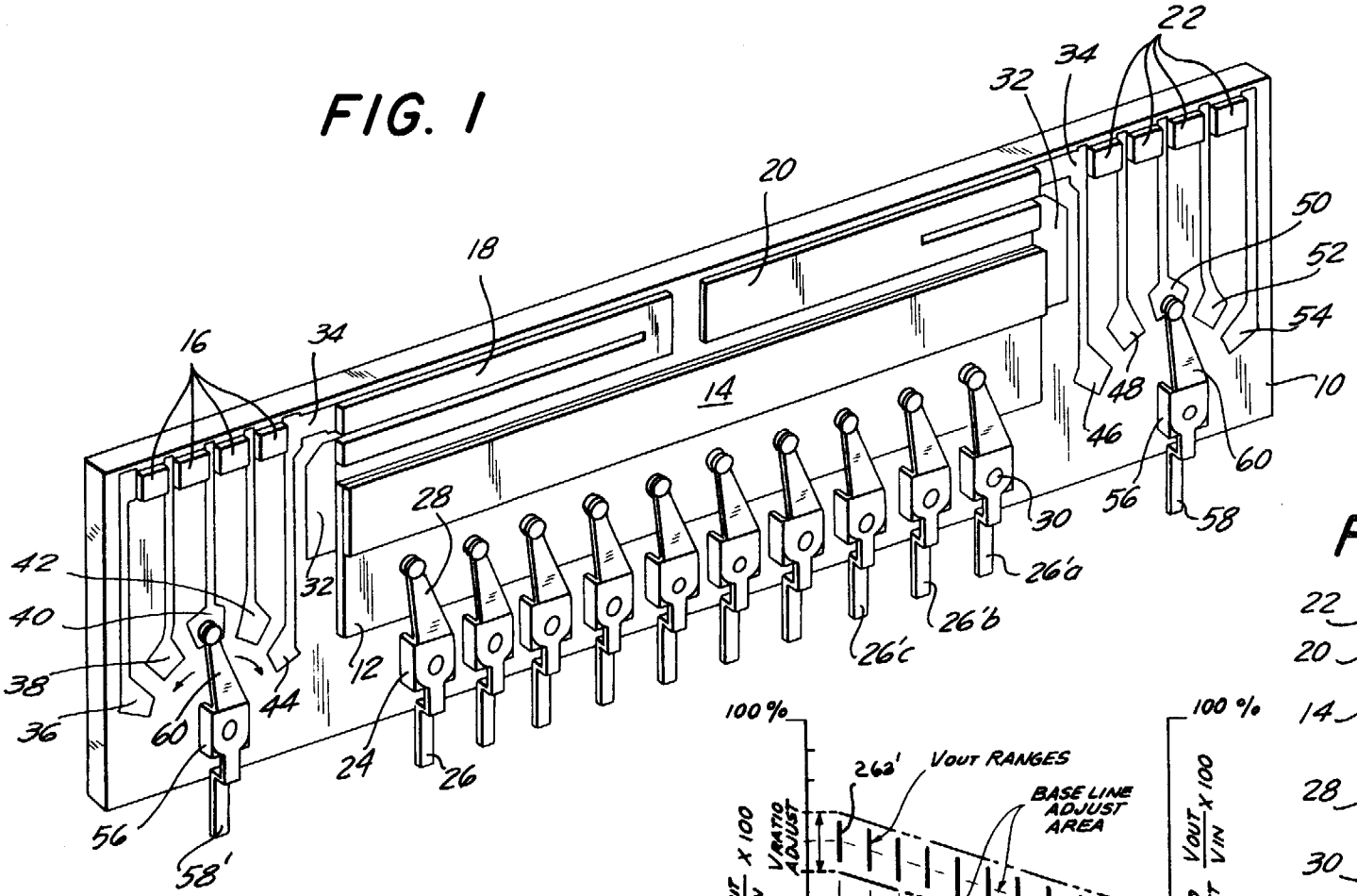
FIG. 1 is a perspective view of a multiple output potentiometer network constructed in accordance with the teachings of this invention.
Figure 4:
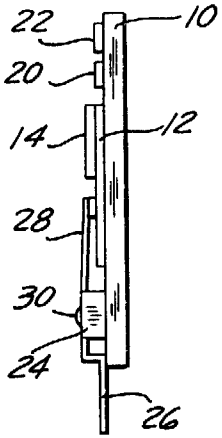
FIG. 4 is a side elevation of the potentiometer network shown in FIG. 1.

In the FIGS. a potentiometer network constructed in accordance with the teachings of this invention is shown. The device includes a substantially rectangular substrate 10 formed of any suitable non-electrically conducting material such as a polyimide. A thin layer 12 of high resistance material such as a conductive plastic film is applied to the substrate in any desired fashion, as by silk screening. In the preferred embodiment of the invention the high resistance element 12 is applied by screening carbon loaded resin onto the substrate at a thickness of 1 to 1.5 mils. A low resistance element 14 consisting also of a carbon loaded resin is screened in rectangular form on top of the high resistance element, also at a depth of approximately 1 to 1.5 mils.

Additional low resistance material to provide elements 16, 18, 20 and 22 is applied directly to the substrate (not over the high resistance element) to provide trimmer resistors.

A plurality of output members 24 are attached to the substrate 10 in spaced relation by suitable means such as riveting. Each of the output members 24 includes a connector portion 26 and a wiper member 28 which is in contact with the high resistance material and movable thereon through a limited arcuate path determined by the pivotal connection of the wiper member to the output member which also can be the means for connecting the output member to the substrate. In the FIGS. such pivotal point and connecting means is shown by the rivet which has been given the numeral 30 for identification. The wiper in the preferred form in Monel and has a contact suitably designed for the purpose as is known in the art.

A plurality of conductors are provided on the substrate to complete the circuit. These conductors are indicated in the FIGS. by the numerals 32, 34, 36, 38, 40, 42, 44, 46, 48, 50, 52 and 54. These conductors can be placed on the substrate by any suitable means, such as etching, and the known printed circuit techniques are used in this application which may utilize copper, silver or any commonly used material. Termination members are provided and in the embodiment shown each of the two termination members are indicated by the numeral 56. Each of these is substantially identical to the output member 24 having a connector portion indicated by the numeral 58 and a wiper indicated by the numeral 60.

As shown herein, the wiper members 28 contact only the high resistance element 12 and the conductors 32 and 34 connect electrically the high resistance element 12 and low resistance element 14 in contact therewith to resistance elements 18 and 20 and resistance elements 16 and 22. One of each resistance element 16 is connected to each of the conductors 36, 38, 40, 42 and 44 and one of the termination members 56 has its wiper 60 positioned so that it can be moved into contact with conductor 36, 38, 40, 42 or 44. Each of the conductors 46, 48, 50, 52 or 54 is in contact with the resistance element 22 and the second termination member is positioned so that its wiper 60 can be in contact with conductor 46, 48, 50, 52 or 54.

In the device shown the input voltage is across the members 58 and output voltages can be taken at each of the output members 24 at its output projection 26.

Figure 5:
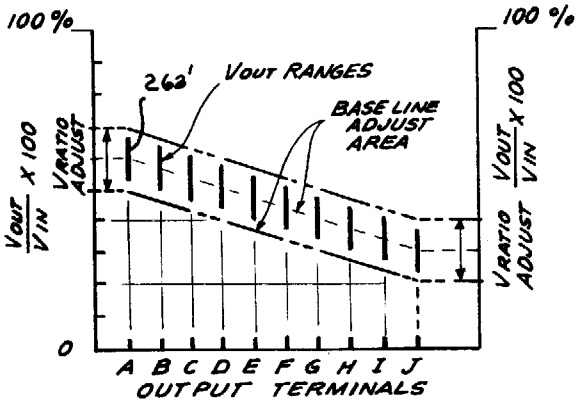
FIG. 5 illustrates as an example several of the curves that can be achieved through use of the potentiometer network shown in FIG. 1.
Figure 2:
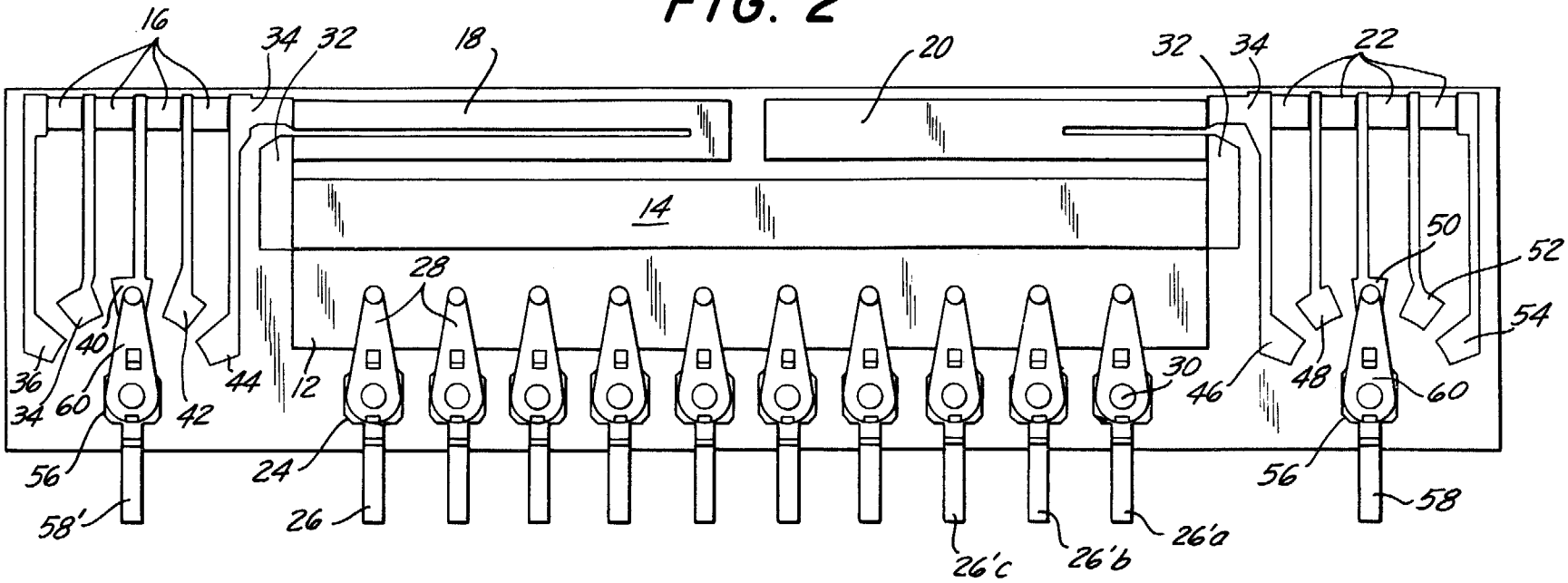
FIG. 2 is a plan view of the potentiometer network shown in FIG. 1.
Figure 3:
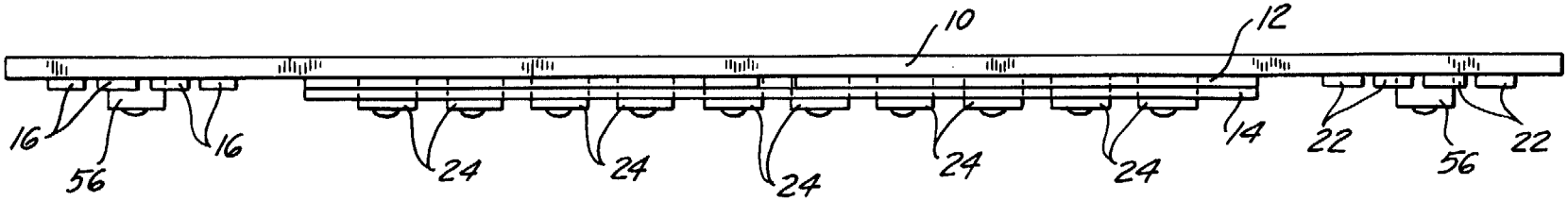
FIG. 3 is a front elevation of the potentiometer network shown in FIG. 1.

FIG. 5 illustrates a plot of the voltage taken across member 58' and members 26 upon the application of input voltage. Numerals of parts shown in FIGS. 1–4 are used to show identity but with a prime.

The output voltage available between member 58' and each of the members 26 can be shown by a series of vertical lines each illustrating the output voltage attainable at one of the output members 26 such as 26'*a*, 26'*b* and 26'*c* for example upon selected switch positions of wipers 60 of switch members 56.

Hence, for example, the wiper 26'*a* will provide one of the voltages shown as determined by the positions of wipers 60 which provide a base line adjustment.

Since the output members are in contact with the high resistance element 12 they are electrically isolated from each other for all purposes and hence the positioning of the wiper members 28 does not affect the achievable output of remaining output members 24. Additionally, each of the output members 24 can be in circuit at the time a particular output member 24 is utilized without creating a loading effect which is noticeable upon the output member 24 being utilized.

We claim:

1. A multiple output potentiometer network having a plurality of variable outputs including in combination a nonelectrical conducting substrate, a thin layer of high resistance material disposed upon said substrate, first and second zones of said high resistance material, a thin layer of low resistance material disposed on said first zone, a plurality of output members mounted on said substrate in spaced relation, a wiper member of each output member in contact with said high resistance material and movable thereon through a limited path, first and second termination means, first and second trimmer resistance means between said first termination means and said second termination means respectively, means for applying a voltage potential between said first and second termination means and means for taking an output voltage between one of said termination means and one of said output members.

2. A multiple output potentiometer network in accordance with claim 1 having first and second low resistance means of fixed non-linear characteristic interposed between said first trimmer resistance and said low resistance material and between said second trimmer resistance and said low resistance material respectively.

* * * * *